United States Patent [19]

Dumont et al.

[11] 4,348,801

[45] Sep. 14, 1982

[54] BALE UNTYING MACHINE

[76] Inventors: Antonio J. Dumont, 74 Boucher St., Edmundston, New Brunswick, Canada, E3V 1P7; Mario Theriault, R.R. #1, Edmundston, New Brunswick, Canada, E3V 3K3

[21] Appl. No.: 187,952

[22] Filed: Sep. 16, 1980

[51] Int. Cl.[3] ..... B26D 7/02; B65B 69/00

[52] U.S. Cl. ..... 29/564.3; 29/566.1; 83/383; 83/580; 83/909; 83/924; 414/412

[58] Field of Search ..... 29/564.3, 566.1; 414/412; 83/382, 383, 385, 100, 909, 924, 580

[56] References Cited

U.S. PATENT DOCUMENTS

| | | | |
|---|---|---|---|
| 2,605,542 | 8/1952 | Upton | 83/382 |
| 2,662,597 | 12/1953 | Ballard et al. | 83/382 X |
| 2,820,282 | 1/1958 | Schneider, Jr. | 29/564.3 |
| 3,137,191 | 6/1964 | O'Brien | 83/567 X |
| 3,513,522 | 5/1970 | Thompson | 29/564.3 |
| 3,606,056 | 9/1971 | Morgan . | |
| 3,757,973 | 9/1973 | Lambert et al. | |

FOREIGN PATENT DOCUMENTS

| | | | |
|---|---|---|---|
| 363647 | 2/1973 | U.S.S.R. | 83/924 |

*Primary Examiner*—Z. R. Bilinsky

[57] ABSTRACT

A machine for untying bales, such as bales of paper in a papermill, and characterized by being adapted to hold the ties, such as wires or metal bands, until after cutting and disposal of the bundle of material from the ties such as to separately dispose of the ties to avoid the ensuing damages and maintenance and to reduce manual labor. The present machine comprises a trolley, a frame suspended to the trolley such as by a hoist, a plurality of cutting heads, one for each tie of a bale, movably suspended to the frame, with each cutting head characterized by a combination of a cutter and a pair of catch members arranged to sequentially catch and hold the ties during cutting and until after the bundle of material of the bale has been disposed of to separately dispose of the ties harmless of the equipment processing the bundle of material.

7 Claims, 7 Drawing Figures

BALE UNTYING MACHINE

FIELD OF THE INVENTION

This invention relates to a machine adapted to untie bales such as bales of paper.

BACKGROUND OF THE INVENTION

It has so far been the practice to untie and undo the bales by hand for instance in papermills for the repulping process using bales of papers. The bales thus used are made of raw paper sheets baled together in 300 pounds bundles tied with baling wire. The unbaling is done by cutting the wires by hand with pliers, grabbing the wires by hand to hold them while the bundle of papers is pushed manually onto the conveyor to the repulper. Very often, wires are allowed to slip and neglectingly find their way to the repulper. Substantial maintenance work is needed to repair the ensuing damages. Besides, all the aforementioned manual work is costly.

SUMMARY OF THE INVENTION

It is a general object of the present invention to provide a bale untying machine adapted to obviate the above-mentioned disadvantages.

It is a more specific object of the present invention to provide a bale untying machine that holds the wires or ties of a bale after cutting thereof to retrieve and separate them from the bundle of material of the bale.

It is another object of the present invention to provide a bale untying machine that is adapted to sequentially cut the ties of a bale and to release the bundle of material of the bale while holding the ties for disposal thereof only thereafter and separate from the bundle of material harmless of the equipment processing the bundle of material.

It is still another object of the present invention to provide a bale untying machine in which there are provided a plurality of cutting heads, one for each tie holding a bale, and with those heads movably supported to adjustably engage the common sets of ties or wires around the bales.

BRIEF DESCRIPTION OF THE DRAWINGS

The above and other objects and advantages of the present invention will be better understood with reference to the following description of a preferred embodiment thereof which is illustrated, by way of example, in the accompanying drawings, in which.

DESCRIPTION OF A PREFERRED EMBODIMENT

Figure 1:
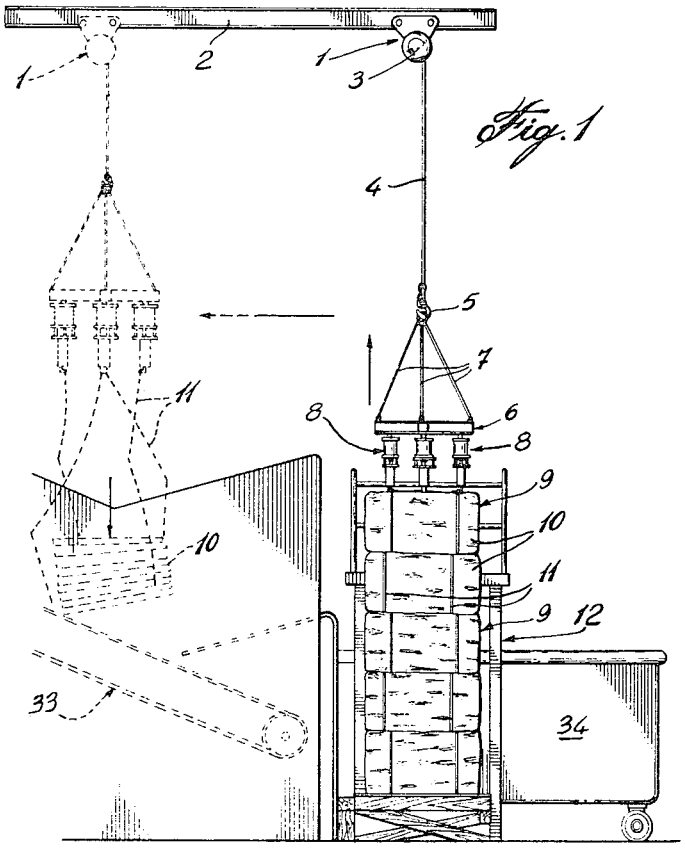
FIG. 1 is a side elevation view of a bale untying machine according to the present invention and shown as used in a papermill for untying bales of paper used for repulping.
Figure 4:
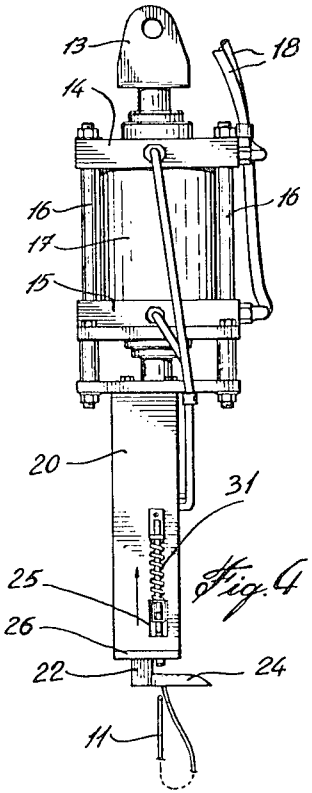
FIGS. 2, 3 and 4 are side elevation views showing two different sides of a cutting head forming part of the bale untying machine according to the present invention.

The illustrated bale untying machine comprises a trolley 1 rollingly carried by an overhead track 2 and made of any common construction as known in the art. The trolley 1 carries a hoist 3 of any appropriate type deploying a cable 4 having a hook 5 at its outer end. A frame 6 is suspended by slings 7 to the hook 5. The frame 6 has a cross shape defined by two tracks intersecting at right angle and centrally relative to each other.

The bale untying machine is particularly characterized by a plurality of cutting heads 8 movably secured to the frame 6 and depending from the latter.

A bale 9 is conventionally made of a bundle of material 10 tied together by a plurality of wires 11. The frame 6 provides for securing different numbers of cutting heads 8 thereto such as to have one cutting head for each wire or tie of any particular bale to cut all of the ties simultaneously. The bales 9 are piled one over the other such as on a rack 12.

As best shown in FIGS. 2 to 7 inclusive, each cutting head includes a clevis 13 at its top adapted to pin it movably to one or the other of the two tracks of the frame 6. The clevis 13 is swivelly connected at the top of the plunger of an upright hydraulic cylinder unit. The latter includes a carrying frame made of a top and bottom plates 14 and 15 and upright connection rods 16. The hydraulic cylinder 17 is mounted upright between the plates 14 and 15 and is connected to an hydraulic fluid supply by hydraulic lines 18.

A casing formed of a front and back plates 19, a side plate 20 and guide strips 20' is secured to a plate 21 suspended to the plate 15 of the carrying frame. A catch member 22 is slidable in the casing and is connected to the plunger 23 of the hydraulic cylinder 17 by a connector block 23'. Thus, the catch member is also fixedly retained while the housing of the hydraulic cylinder is displaceable. The free end of the catch member 22 is formed with a lateral projection 24 extending in forward direction and adapted to catch under a wire or tie 11 of a bale. Lateral projection 24 has a cutting edge 24' at one end and a top tie-supporting surface 24'' adjacent cutting edge 24'. The side plate 20 of the aforementioned casing is formed with a slot 25 that extends upwardly in a plane parallel to the front of the casing.

A cutter 26 is secured to the lower end of the plate 20 and has a shearing edge 26' shearingly adjoining cutting edge 24' of projection 24 of the catch member 22 and extending in the same forward direction as the projection 24.

A second catch member 27 in the form of an L-shaped lever is pivoted to the other catch member 22 by a pivot 28 extending in the forward direction. The lever 27 includes a catching head or portion 29 having a dented edge, as shown, adapted to bite and catch on top of the wire 11 upon appropriate pivoting of the lever. The latter extends in the plane of the slot 24 and includes an actuating arm 30 projecting through the slot. A compression spring 31 is connected to downwardly bias the arm 30 until, at the most, it abuts against the abutment defined by the lower end of the slot 25.

Figure 3:
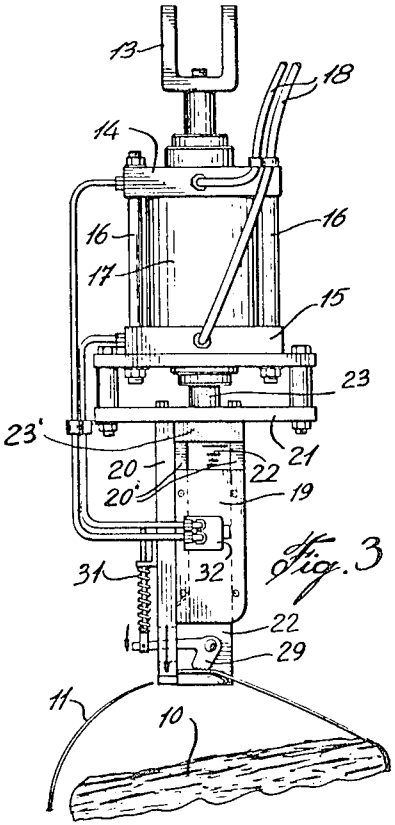
Figure 2:
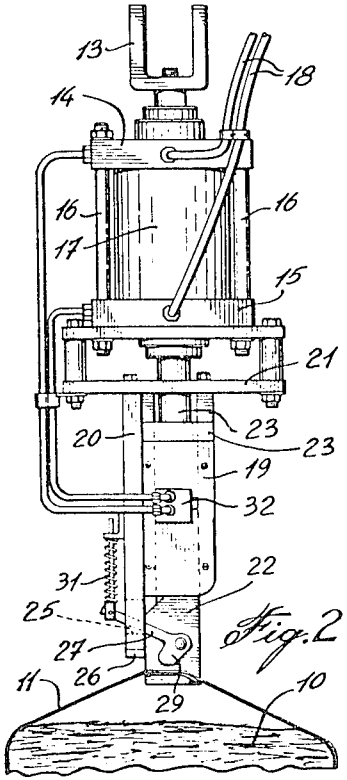
Figure 5:
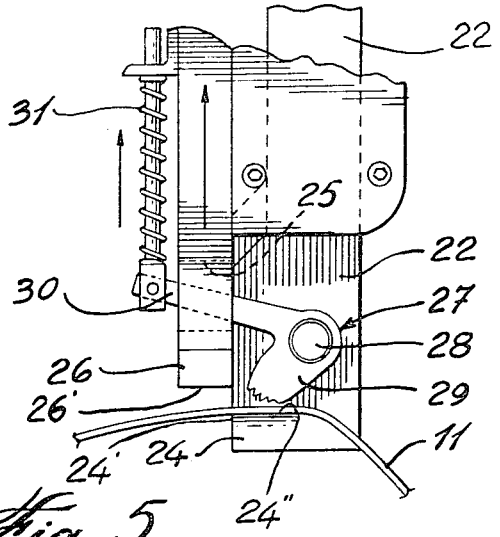
FIGS. 5, 6 and 7 are detailed side views sequentially showing the operation of the cutting heads forming part of the bale untying machine.
Figure 6:
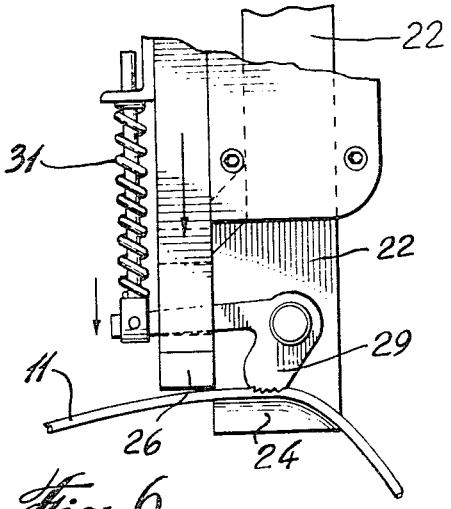
Figure 7:
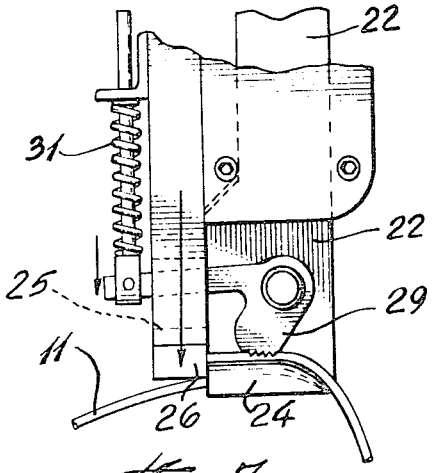

At the start of the operation, the cutting heads 8 have each their cylinder 17 and casing 19, 20 in their upper postion relative to plunger 23, so that catch member 22 is fully extended as shown in FIGS. 2 and 5, and lever 27 is kept in releasing position by engaging the lower end of slot 25. Therefore projection 24 can be engaged under the corresponding tie or wire 11. A relief valve at 32 is then activated to allow the housing of the hydraulic cylinder and the plates 19, 20 to move down under their weight along plunger 23 and catch member 22, whereby spring 31 causes the catching portion 29 to catch on the wire, and prevent slipping of the projection from under the wire during bale transport (see FIG. 6).. When the thus-supported bale has been transported to the unloading position for the bundle of material, such as above the conveyor 33 in FIG. 1, the hydraulic cylinder is actuated, as shown in FIGS. 3 and 7, to move the cutter 26 downward thus causing the blade 26 to shear the wire. At the same time, the cam portion 29 of lever 27 is further pressed down on the wire by spring 31. Any pulling action on the wire will cause cam portion 29 to further increase its clamping action on the wire, so that the wires, after unloading of the bundle of material on conveyor 33, can be transported to a position over a truck 34 or the like collector and released into the same. Downward displacement of the housing of the hydraulic cylinder and the depending plate 20 produces catching of a wire by counterclockwise pivoting of the catching lever 27 on catch member 22, cutting or shearing of the wire, and thereafter upward movement of the housing of the hydraulic cylinder and plate 20 causes release of the wire.

What we claim is:

1. A bale untying tool comprising a first catch member having a lateral projection engageable under a tie secured around a bale of material, said lateral projection having a first cutting edge at one end and a tie-supporting surface adjacent said first cutting edge, a second catch member movably mounted on said first catch member and co-operating with said tie-supporting surface to engage and clamp said tie with said tie extending over said cutting edge, a cutter member mounted on said first catch member for movement relative to the same independently of said second catch member and having a second cutting edge co-operable with said first cutting edge to engage and shear said tie, means to move said cutter member towards and away from said first cutting edge, biasing means extending between said second catch member and said cutter member and biasing said second catch member to clamp said tie against said tie-supporting surface prior to shearing of said tie by said cutting edges, and means operable by movement of said cutter away from said first cutting edge to cause release of said tie by said second catch member.

2. A bale untying tool as claimed in claim 1, wherein said second catch member has a catching portion in the form of a cam which increases its clamping action on the tie upon pulling of said tie in a direction away from said first cutting edge.

3. A bale untying tool as defined in claim 2, wherein said means to move said cutter includes a double-action hydraulic cylinder having a piston connected to said first catch member and its cylinder connected to said cutter member.

4. A bale untying tool as claimed in claim 3, further including a casing surrounding and guided by said first catch member for sliding movement therealong, said casing carrying said cutter and fixed to said cylinder.

5. A bale untying tool as claimed in claim 4, wherein said second catch member has a lever projecting from said catching portion, said cutter having a slot receiving said lever, said means operable by movement of said cutter away from said first cutting edge consisting of said lever engaging the lower edge of said slot upon movement of said cutter away from said first cutting edge.

6. A bale untying tool as defined in claim 5, wherein said biasing means extends between the outer end of said lever and said cutter member.

7. A bale untying machine including a plurality of bale-untying tools as defined in claim 1, 2 or 3, each tool arranged to cut each of the ties co-operatively holding a bundle of material into a bale, said machine including a supporting frame with said tools being suspended from said supporting frame at their ends away from said projection, and means to hoist said supporting frame and move the same in horizontal directions.

* * * * *